US007156367B1

(12) United States Patent
Huang et al.

(10) Patent No.: US 7,156,367 B1
(45) Date of Patent: Jan. 2, 2007

(54) GAS CONTROL KNOB THAT IS OPERATED MANUALLY OR AUTOMATICALLY

(75) Inventors: Ching-Ying Huang, Taichung (TW); Hsin-Ming Huang, Taichung (TW); Hsin-Hsiung Huang, Taichung (TW); Pao-Hui Huang, Taichung (TW); Chung-Sheng Yen, Taichung (TW); Ching-Chieh Hung, Taichung (TW)

(73) Assignee: Chung-Chin Huang, Taichung (TW)

( * ) Notice: Subject to any disclaimer, the term of this patent is extended or adjusted under 35 U.S.C. 154(b) by 0 days.

(21) Appl. No.: 11/179,876

(22) Filed: Jul. 12, 2005

(51) Int. Cl.
*F16K 31/02* (2006.01)
*F16K 31/44* (2006.01)
*F16K 5/00* (2006.01)

(52) U.S. Cl. ..... 251/129.11; 251/129.03; 251/249.5; 251/310

(58) Field of Classification Search ..... 251/129.1, 251/129.03, 129.11, 249.5, 310, 292
See application file for complete search history.

(56) References Cited

U.S. PATENT DOCUMENTS 2,203,613 A * 6/1940 Cyr ..... 251/129.11
4,686,863 A * 8/1987 Inoue et al. ..... 251/129.12
5,345,834 A * 9/1994 Hayashi ..... 74/425
5,570,606 A * 11/1996 Irie ..... 74/425
6,257,271 B1 * 7/2001 Babin et al. ..... 251/129.11
6,471,580 B1 * 10/2002 Ro ..... 251/129.11

* cited by examiner

*Primary Examiner*—Justine R. Yu
*Assistant Examiner*—Andrew J. Rost
(74) *Attorney, Agent, or Firm*—Alan D. Kamrath; Nikolai & Mersereau, P.A.

(57) ABSTRACT

A gas control knob includes a main body having a gas inlet hole and a gas outlet hole, a throttling cock rotatably mounted in the main body to regulate the gas flow rate between the gas inlet hole and the gas outlet hole of the main body, a rotation lever rotatably mounted on the main body to rotate the throttling cock, and a motor mounted on a fixing bracket to drive a transmission mechanism automatically which drives a clutch mechanism to drive and rotate the rotation lever to rotate the throttling cock. Thus, the gas control knob is operated manually or automatically, thereby facilitating a user operating the gas control knob.

12 Claims, 8 Drawing Sheets

GAS CONTROL KNOB THAT IS OPERATED MANUALLY OR AUTOMATICALLY

BACKGROUND OF THE INVENTION

1. Field of the Invention

The present invention relates to a gas control knob, and more particularly to a gas control knob for a gas stove or range.

2. Description of the Related Art

A conventional gas control knob for a gas stove comprises a main body, an end cap mounted on the main body, a throttling cock rotatably mounted in the main body to regulate the gas flow rate, a rotation lever rotatably mounted on the end cap and connected to the throttling cock to control movement of the throttling cock so as to regulate the gas flow rate, and a handle secured on the rotation lever to rotate the rotation lever. However, the conventional gas control knob is operated manually and cannot be operated in a remote control manner, thereby wasting the manual work, and easily causing inconvenience to the user

SUMMARY OF THE INVENTION

The primary objective of the present invention is to provide a gas control knob that is selectively operated manually or automatically, thereby facilitating a user operating the gas control knob.

Further benefits and advantages of the present invention will become apparent after a careful reading of the detailed description with appropriate reference to the accompanying drawings.

DETAILED DESCRIPTION OF THE INVENTION

Figure 1:
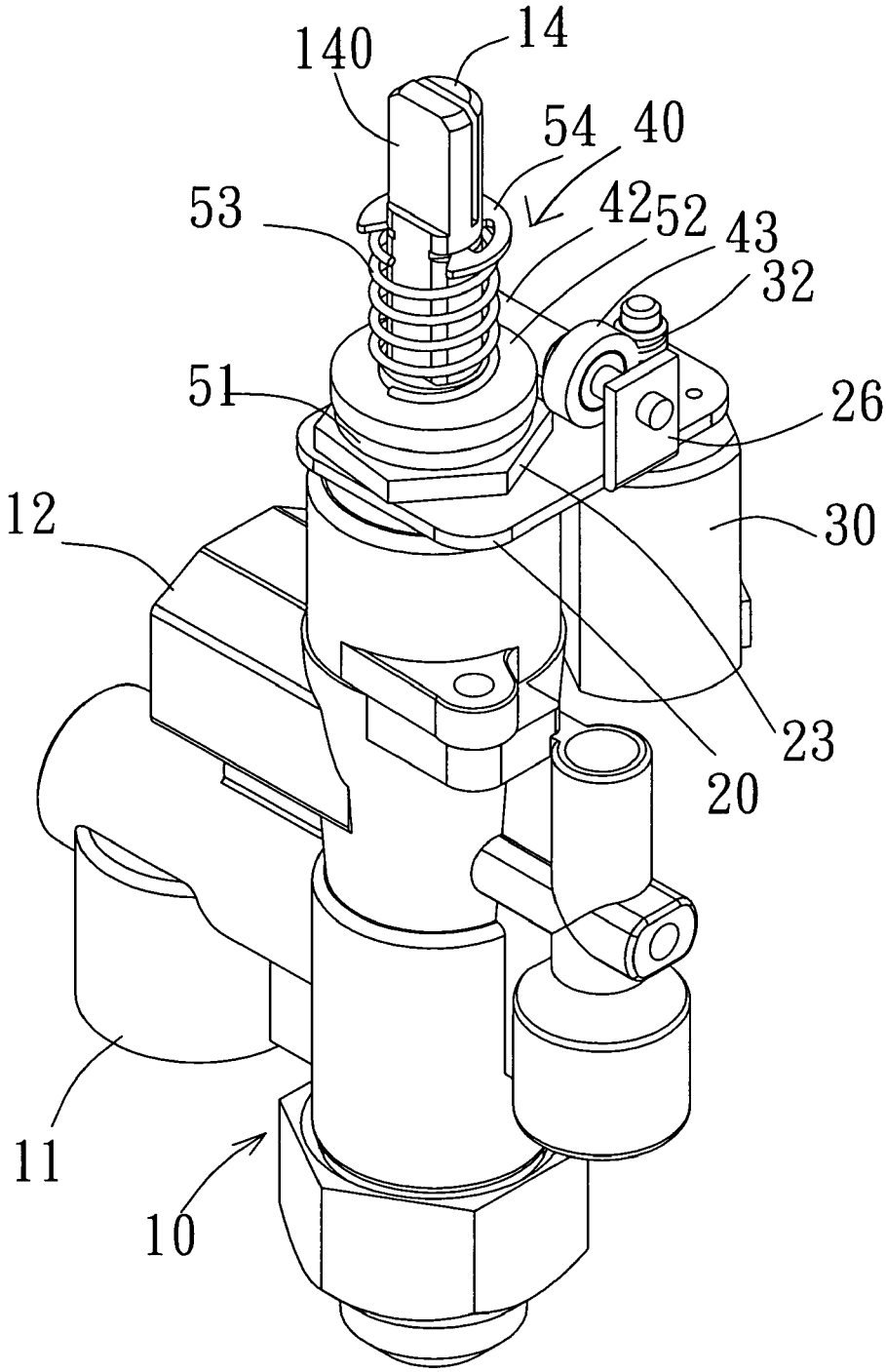
FIG. 1 is a perspective view of a gas control knob in accordance with the preferred embodiment of the present invention.
Figure 2:
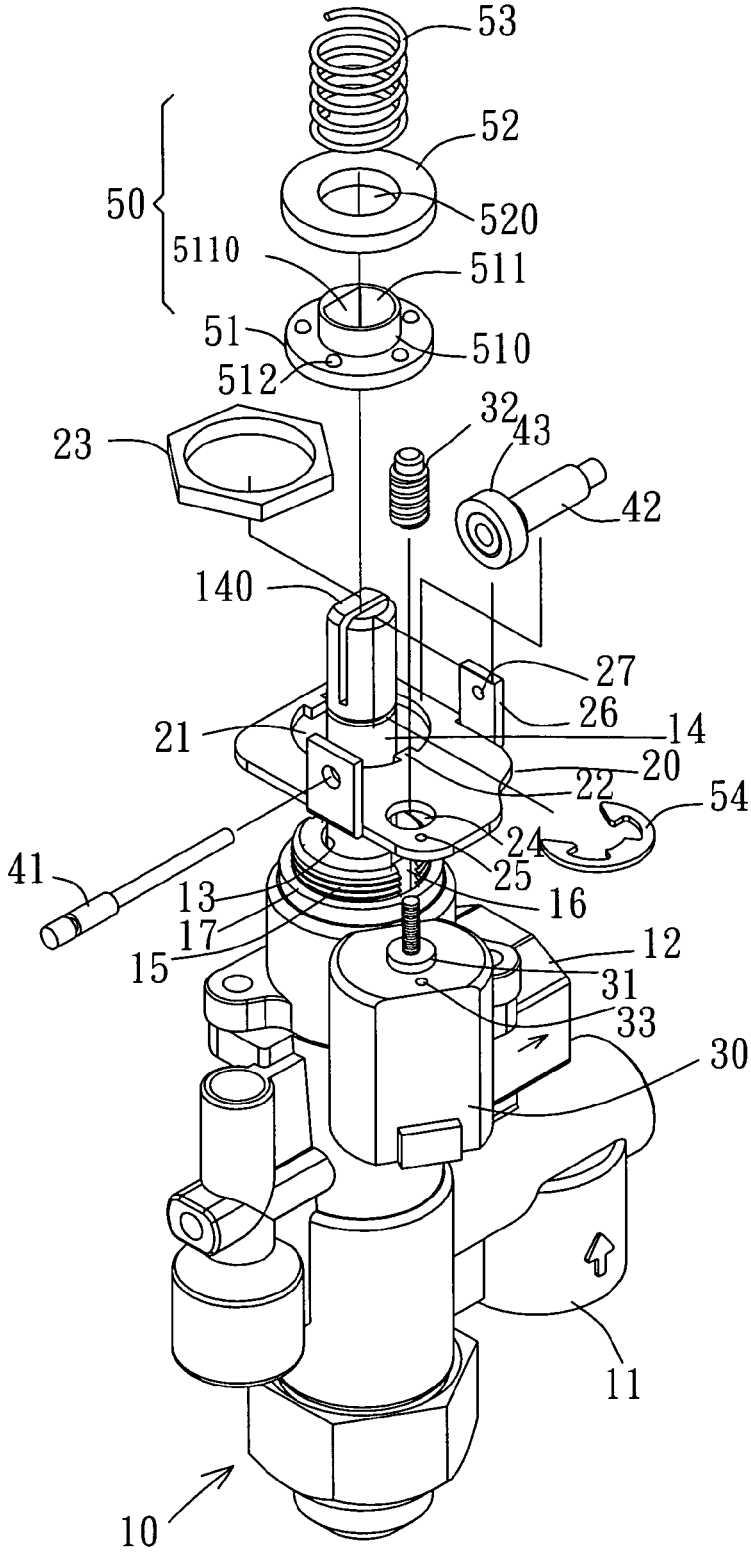
FIG. 2 is an exploded perspective view of the gas control knob taken along line 3—3 as shown in FIG. 1.
Figure 3:
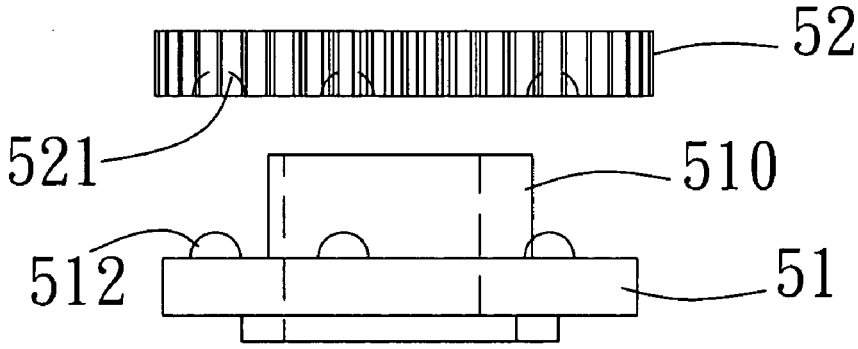
FIG. 3 is a partially plan exploded view of the gas control knob as shown in FIG. 1.
Figure 4:
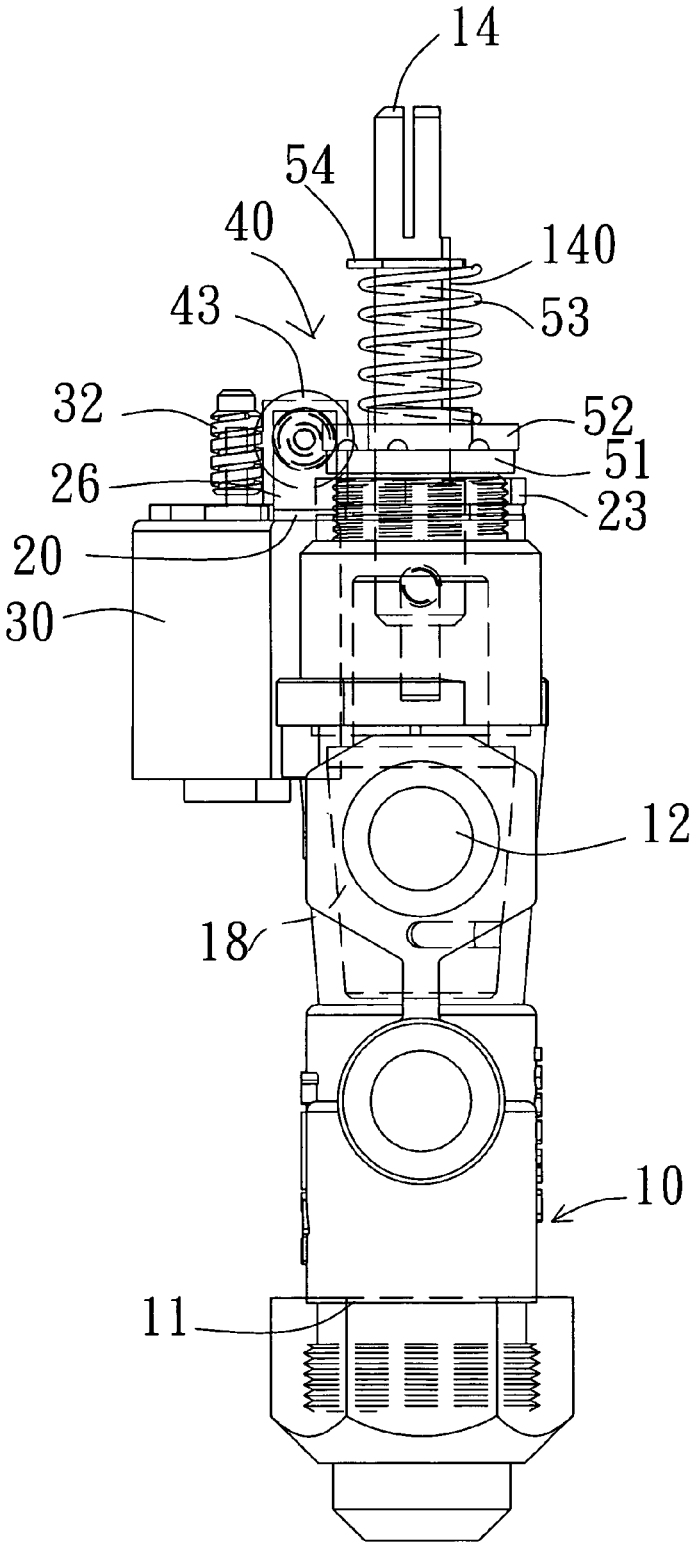
FIG. 4 is a front plan view of the gas control knob as shown in FIG. 1.
Figure 5:
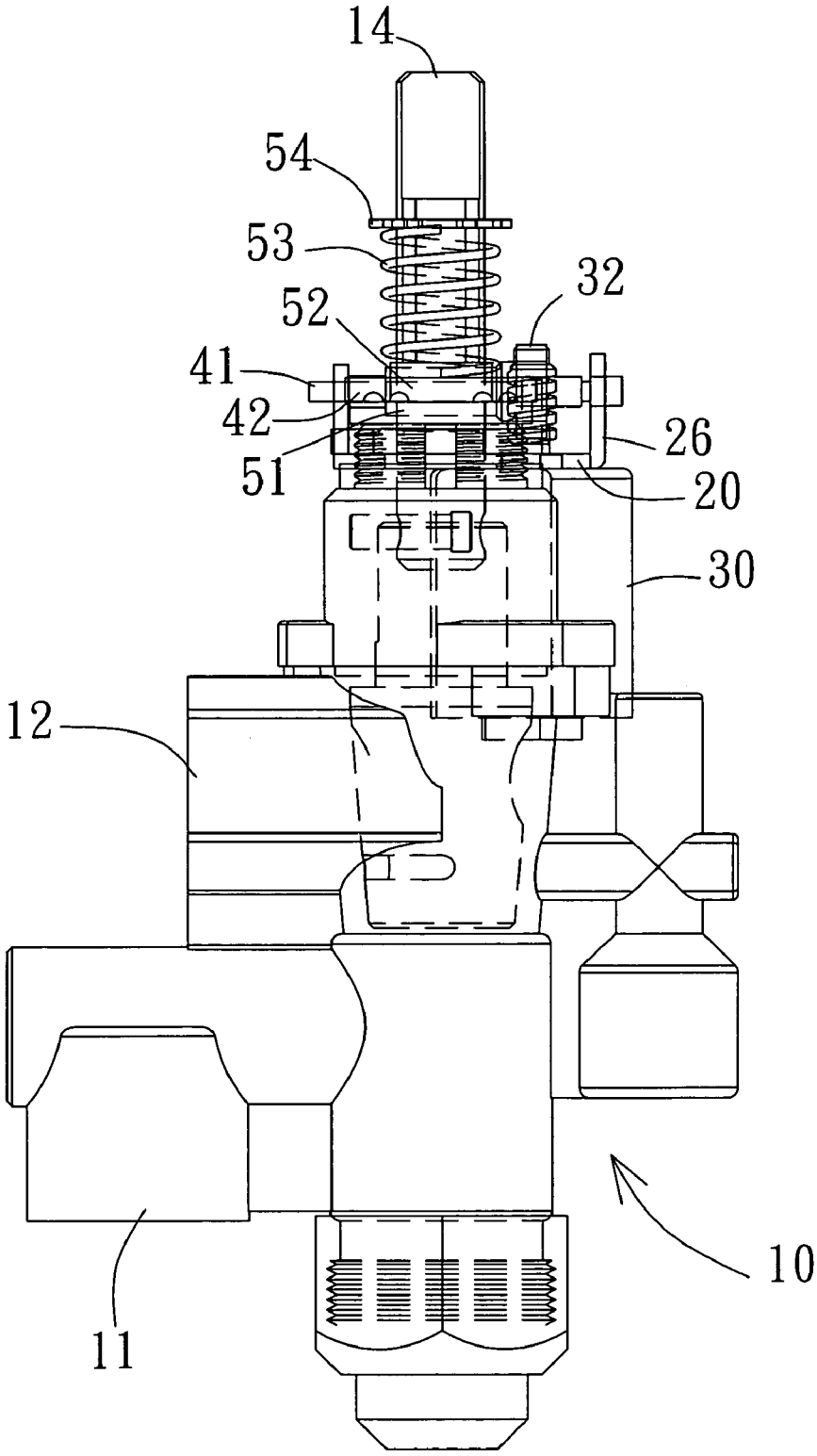
FIG. 5 is a side plan view of the gas control knob as shown in FIG. 1.
Figure 6:
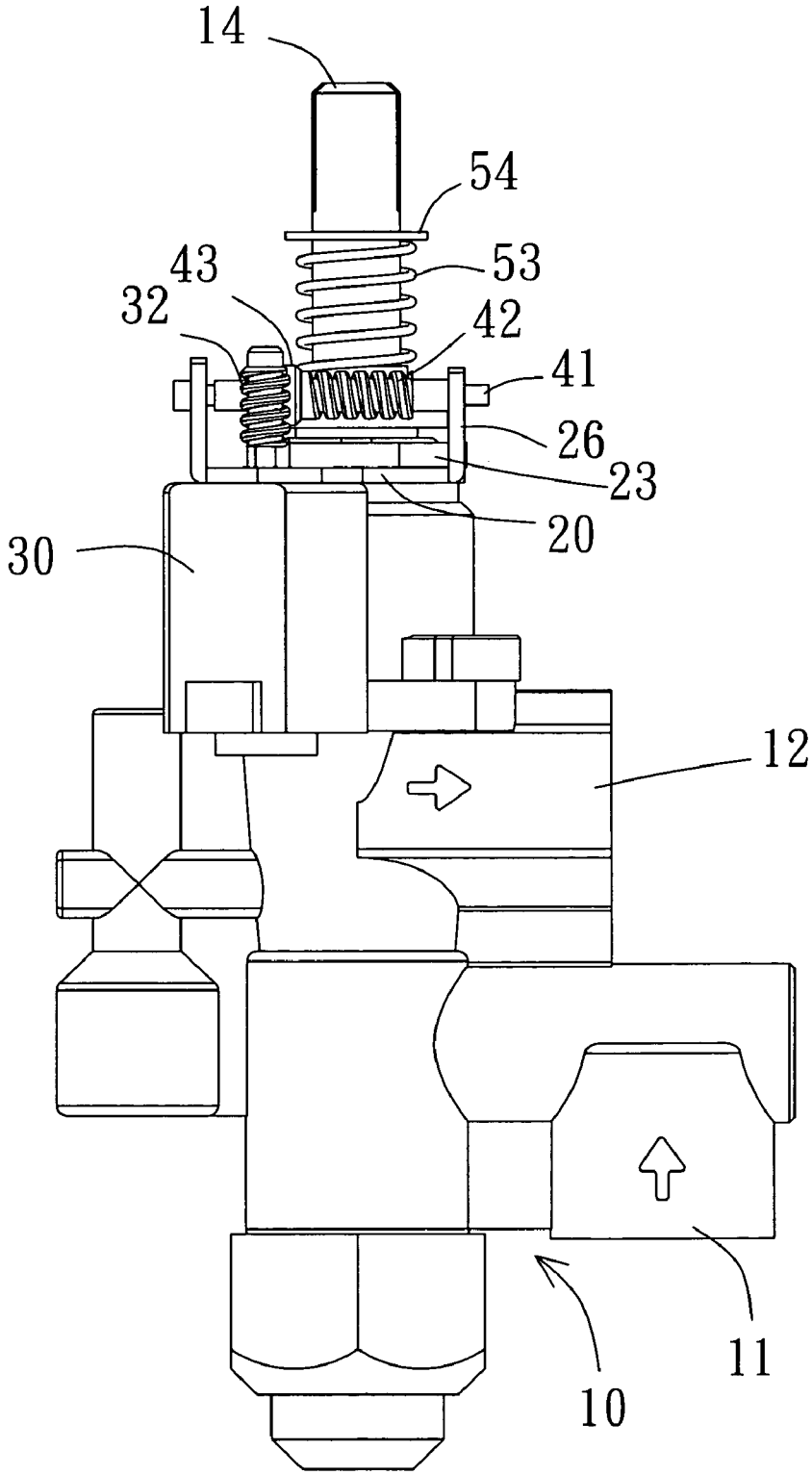
FIG. 6 is a rear plan view of the gas control knob as shown in FIG. 1.

Referring to the drawings and initially to FIGS. 1–6, a gas control knob for a gas stove in accordance with the preferred embodiment of the present invention comprises a main body 10 having a gas inlet hole 11, a gas outlet hole 12 and a mounting hole 13 connected between the gas inlet hole 11 and the gas outlet hole 12, a throttling cock 18 (see FIG. 4) rotatably mounted in the main body 10 and located between the gas inlet hole 11 and the gas outlet hole 12 of the main body 10 to regulate a gas flow rate between the gas inlet hole

11 and the gas outlet hole 12 of the main body 10, a rotation lever 14 rotatably mounted in the mounting hole 13 of the main body 10 and having a first end secured to the throttling cock 18 to rotate the throttling cock 18 and a second end protruding outward from the main body 10, a fixing bracket 20 mounted on the main body 10; a motor 30 mounted on the fixing bracket 20 to drive a transmission mechanism 40 (see FIG. 4) automatically which drives a clutch mechanism 50 to drive and rotate the rotation lever 14 to rotate the throttling cock 18 so as to regulate the gas flow rate between the gas inlet hole 11 and the gas outlet hole 12 of the main body 10. Alternatively, when the rotation lever 14 is rotated manually, the clutch mechanism 50 is separated from the transmission mechanism 40 and the motor 30.

The main body 10 has an end face formed with a threaded portion 15. The threaded portion 15 of the main body 10 has a root portion formed with an annular shoulder 17 and a periphery formed with two axially extended splines 16 extended to the shoulder 17.

The second end of the rotation lever 14 has a side formed with an axially extended flattened face 140.

The fixing bracket 20 is mounted on the shoulder 17 of the main body 10 and has an inside formed with a passage 21 to allow passage of the threaded portion 15 of the main body 10. The passage 21 of the fixing bracket 20 has a periphery formed with two radially and inwardly extended keys 22 each mounted in a respective one of the splines 16 of the main body 10 so that the fixing bracket 20 is secured on the main body 10 without rotation. The fixing bracket 20 has a side formed with a mounting bore 24 and a locking hole 25 and has a periphery formed with two spaced pivot ears 26 each formed with a pivot hole 27.

A retaining nut 23 is screwed onto the threaded portion 15 of the main body 10 and rested on the fixing bracket 20 to fix the fixing bracket 20 on the main body 10.

The motor 30 is mounted on the bottom of the fixing bracket 20 and has a drive worm 32 protruding from the fixing bracket 20. The motor 30 has an end face provided with a bushing 31 mounted in the mounting bore 24 of the fixing bracket 20 and formed with a screw bore 33 secured to the locking hole 25 of the fixing bracket 20 by a bolt (not shown) to secure the motor 30 to the bottom of the fixing bracket 20.

The transmission mechanism 40 includes a shaft 41 mounted on the fixing bracket 20, and a transmission worm 42 rotatably mounted on the shaft 41 and having an end provided with a transmission wormwheel 43 meshing with and rotated by the drive worm 32 of the motor 30. The shaft 41 of the transmission mechanism 40 is mounted between the two pivot ears 26 of the fixing bracket 20 and has two ends each mounted in the respective pivot hole 27 of the fixing bracket 20. Thus, the motor 30 is operated in a wire control manner or a remote control manner to drive and rotate the transmission worm 42.

The clutch mechanism 50 includes a fixing disk 51 secured on the second end of the rotation lever 14 to rotate the rotation lever 14, a driven wormwheel 52 meshing with and rotated by the transmission worm 42 and urged on the fixing disk 51 to rotate the fixing disk 51, a snap ring 54 mounted on the second end of the rotation lever 14, and a spring 53 mounted on the second end of the rotation lever 14 and biased between the driven wormwheel 52 and the snap ring 54 to push the driven wormwheel 52 toward the fixing disk 51 so that the driven wormwheel 52 is urged on the fixing disk 51 closely.

The fixing disk 51 has a surface provided with a plurality of protruding balls 512 and has a central portion formed with a co-axial hub 510 having a fixing hole 511 mounted on the second end of the rotation lever 14. The fixing hole 511 of the fixing disk 51 has a side formed with an axially extended flattened face 5110 rested on the flattened face 140 of the rotation lever 14 so that the fixing disk 51 secured on the second end of the rotation lever 14.

The driven wormwheel 52 has a surface formed with a plurality of ball holes 521 (see FIG. 3), and the protruding balls 512 of the fixing disk 51 are detachably mounted in the ball holes 521 of the driven wormwheel 52. The driven wormwheel 52 has a central portion formed with a through hole 520 mounted on the hub 510 of the fixing disk 51.

Figure 7:
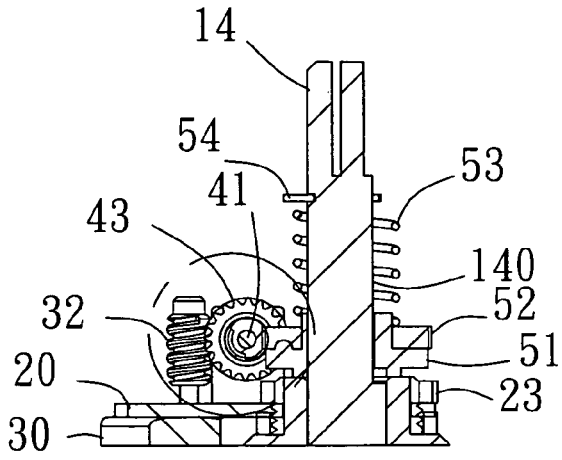
FIG. 7 is a plan cross-sectional view of the gas control knob as shown in FIG. 6.
Figure 8:
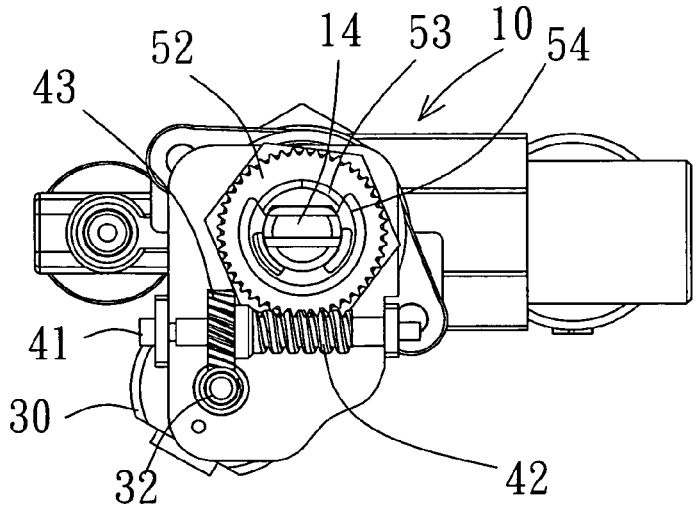
FIG. 8 is a top plan view of the gas control knob as shown in FIG. 6.
Figure 9:
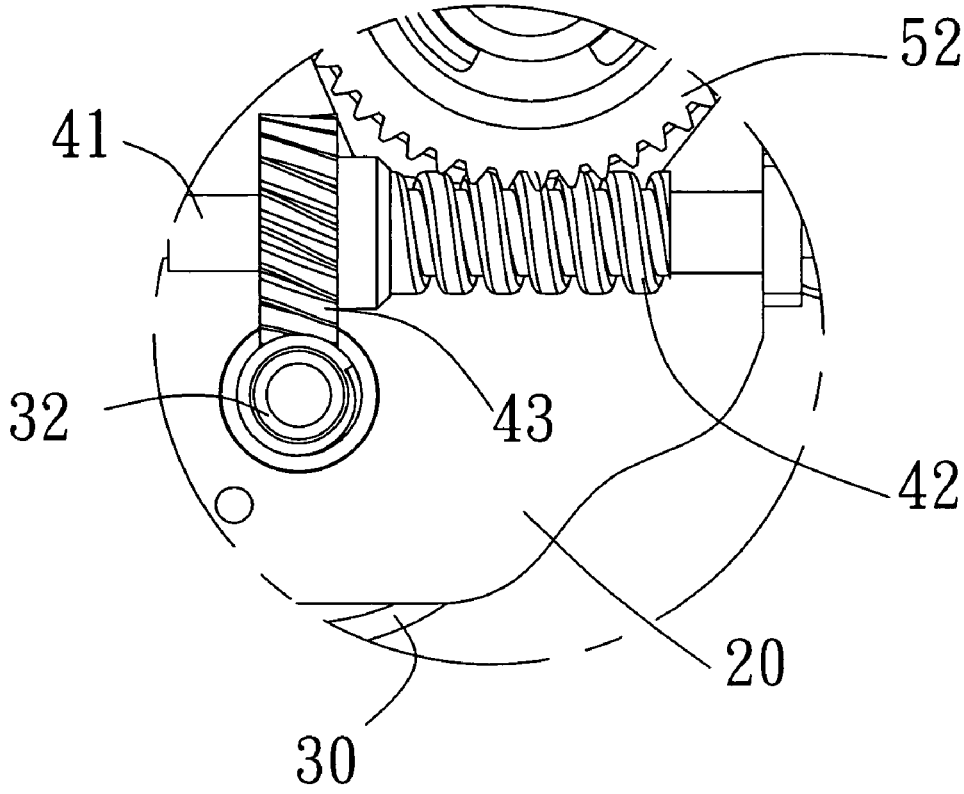
FIG. 9 is a locally enlarged view of the gas control knob as shown in FIG. 8.

Referring to FIGS. 1–9, the motor 30 is operated in a wire control manner or a remote control manner to rotate the drive worm 32 which rotates the transmission wormwheel 43 which rotates the transmission worm 42 which rotates the driven wormwheel 52. At this time, the driven wormwheel 52 is urged on the fixing disk 51 closely by the elastic force of the spring 53 so that the protruding balls 512 of the fixing disk 51 are locked in the ball holes 521 of the driven wormwheel 52. Thus, the fixing disk 51 is combined with the driven wormwheel 52, so that the fixing disk 51 is rotated by the driven wormwheel 52 to rotate the rotation lever 14 which rotates the throttling cock 18 so as to regulate the gas flow rate between the gas inlet hole 11 and the gas outlet hole 12 of the main body 10. In such a manner, the rotation lever 14 is rotated automatically so as to regulate the gas flow rate of the gas stove automatically.

Alternatively, the rotation lever 14 is directly rotated manually so as to regulate the gas flow rate of the gas stove manually. At this time, the fixing disk 51 is rotated by the rotation lever 14, and the driven wormwheel 52 is disposed at a stationary state when the motor 30 is not operated. In such a manner, the fixing disk 51 is rotated relative to the driven wormwheel 52, and the protruding balls 512 of the fixing disk 51 are detached from the ball holes 521 of the driven wormwheel 52 to push the driven wormwheel 52 upward to overcome the elastic force of the spring 53, so that the fixing disk 51 slips from the driven wormwheel 52, thereby interrupting the power transmission between the fixing disk 51 and the driven wormwheel 52. Thus, the clutch mechanism 50 is separated from the transmission mechanism 40 and the motor 30 when the rotation lever 14 is rotated manually.

Accordingly, the gas control knob is selectively operated manually or automatically, thereby facilitating a user operating the gas control knob.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A gas control knob, comprising:

a main body having a gas inlet hole, a gas outlet hole and a mounting hole connected between the gas inlet hole and the gas outlet hole;

a throttling cock rotatably mounted in the main body and located between the gas inlet hole and the gas outlet hole of the main body to regulate a gas flow rate between the gas inlet hole and the gas outlet hole of the main body;

a rotation lever rotatably mounted in the mounting hole of the main body and having a first end secured to the throttling cock to rotate the throttling cock and a second end protruding outward from the main body;

a fixing bracket mounted on the main body;

a motor mounted on the fixing bracket to drive a transmission mechanism automatically which drives a clutch mechanism to drive and rotate the rotation lever to rotate the throttling cock so as to regulate the gas flow rate between the gas inlet hole and the gas outlet hole of the main body;

wherein the motor is mounted on a bottom of the fixing bracket and has a drive worm protruding from the fixing bracket, and the transmission mechanism includes a shaft mounted on the fixing bracket, and a transmission worm rotatable mounted on the shaft and having an end provided with a transmission wormwheel meshing with and rotated by the drive worm of the motor;

the clutch mechanism includes a fixing disk secured on the second end of the rotation lever to rotate the rotation lever, a driven wormwheel meshing with and rotated by the transmission worm and urged on the fixing disk to rotate the fixing disk;

the clutch mechanism further includes a snap ring mounted on the second end of the rotation lever, and a spring mounted on the second end of the rotation lever and biased between the driven wormwheel and the snap ring to push the driven wormwheel toward the fixing disk so that the driven wormwheel is urged on the fixing disk closely.

2. The gas control knob in accordance with claim 1, wherein the clutch mechanism is separated from the transmission mechanism and the motor when the rotation lever is rotated manually.

3. The gas control knob in accordance with claim 1, wherein the fixing bracket has a periphery formed with two spaced pivot ears each formed with a pivot hole, and the shaft of the transmission mechanism is mounted between the two pivot ears of the fixing bracket and has two ends each mounted in the respective pivot hole of the fixing bracket.

4. The gas control knob in accordance with claim 1, wherein the fixing disk has a central portion formed with a co-axial hub having a fixing hole mounted on the second end of the rotation lever.

5. The gas control knob in accordance with claim 4, wherein the second end of the rotation lever has a side formed with an axially extended flattened face, and the fixing hole of the fixing disk has a side formed with an axially extended flattened face rested on the flattened face of the rotation lever so that the fixing disk secured on the second end of the rotation lever.

6. The gas control knob in accordance with claim 4, wherein the driven wormwheel has a central portion formed with a through hole mounted on the hub of the fixing disk.

7. The gas control knob in accordance with claim 1, wherein the fixing bracket has a side formed with a mounting bore, and the motor has an end face provided with a bushing mounted in the mounting bore of the fixing bracket.

8. The gas control knob in accordance with claim 1, wherein the fixing bracket has a side a locking hole, and the motor has an end face formed with a screw bore secured to the locking hole of the fixing bracket to secure the motor to the bottom of the fixing bracket.

9. A gas control knob, comprising:

a main body having a gas inlet hole, a gas outlet hole and a mounting hole connected between the gas inlet hole and the gas outlet hole;

a throttling cock rotatable mounted in the main body and located between the gas inlet hole and the gas outlet hole of the main body to regulate a gas flow rate between the gas inlet hole and the gas outlet hole of the main body;

a rotation lever rotatably mounted in the mounting hole of the main body and having a first end secured to the throttling cock to rotate the throttling cock and a second end protruding outward from the main body;

a fixing bracket mounted on the main body;

a motor mounted on the fixing bracket to drive a transmission mechanism automatically which drives a clutch mechanism to drive and rotate the rotation lever to rotate the throttling cock so as to regulate the gas flow rate between the gas inlet hole and the gas outlet hole of the main body;

wherein the motor is mounted on a bottom of the fixing bracket and has a drive worm protruding from the fixing bracket, and the transmission mechanism includes a shaft mounted on the fixing bracket, and a transmission worm rotatable mounted on the shaft and having an end provided with a transmission wormwheel meshing with and rotated by the drive worm of the motor;

the clutch mechanism includes a fixing disk secured on the second end of the rotation lever to rotate the rotation lever, a driven wormwheel meshing with and rotated by the transmission worm and urged on the fixing disk to rotate the fixing disk;

the driven wormwheel has a surface formed with a plurality of ball holes, and the fixing disk has a surface provided with a plurality of protruding balls detachably mounted in the ball holes of the driven wormwheel.

10. A gas control knob, comprising:

a main body having a gas inlet hole, a gas outlet hole and a mounting hole connected between the gas inlet hole and the gas outlet hole;

a throttling cock rotatable mounted in the main body and located between the gas inlet hole and the gas outlet hole of the main body to regulate a gas flow rate between the gas inlet hole and the gas outlet hole of the main body;

a rotation lever rotatable mounted in the mounting hole of the main body and having a first end secured to the throttling cock to rotate the throttling cock and a second end protruding outward from the main body;

a fixing bracket mounted on the main body;

a motor mounted on the fixing bracket to drive a transmission mechanism automatically which drives a clutch mechanism to drive and rotate the rotation lever to rotate the throttling cock so as to regulate the gas flow rate between the gas inlet hole and the gas outlet hole of the main body;

wherein the main body has an end face formed with a threaded portion, the threaded portion of the main body has a root portion formed with an annular shoulders;

the fixing bracket is mounted on the shoulder of the main body and has an inside formed with a passage to allow passage of the threaded portion of the main body.

11. The gas control knob in accordance with claim 10, wherein the threaded portion of the main body has a periphery formed with two axially extended splines extended to the shoulder, and the passage of the fixing bracket has a periphery formed with two radially and inwardly extended keys each mounted in a respective one of the splines of the main body so that the fixing bracket is secured on the main body without rotation.

12. The gas control knob in accordance with claim 10, further comprising a retaining nut screwed onto the threaded portion of the main body and rested on the fixing bracket to fix the fixing bracket on the main body.

* * * * *